US008621865B2

(12) United States Patent
Mehring et al.

(10) Patent No.: US 8,621,865 B2
(45) Date of Patent: Jan. 7, 2014

(54) INTERNAL COMBUSTION ENGINE WITH LIQUID-COOLED TURBINE

(75) Inventors: Jan Mehring, Cologne (DE); Ludwig Stump, Cologne (DE); Kai Sebastian Kuhlbach, Bergisch Gladbach (DE); Bernd Steiner, Bergisch Gladbach (DE); Carsten Weber, Leverkusen (DE); Franz J. Brinkmann, Huerth-Efferen (DE); Frank Kraemer, Neunkirchen-Seelscheid (DE); Jens Groeger, Glashuette (DE)

(73) Assignee: Ford Global Technologies, LLC, Dearborn, MI (US)

( * ) Notice: Subject to any disclaimer, the term of this patent is extended or adjusted under 35 U.S.C. 154(b) by 154 days.

(21) Appl. No.: 13/253,817

(22) Filed: Oct. 5, 2011

(65) Prior Publication Data

US 2012/0067306 A1 Mar. 22, 2012

Related U.S. Application Data

(63) Continuation-in-part of application No. 13/099,702, filed on May 3, 2011, and a continuation-in-part of application No. 13/226,267, filed on Sep. 6, 2011.

(30) Foreign Application Priority Data

| | | |
|---|---|---|
| May 4, 2010 | (EP) | 10161879 |
| Sep. 7, 2010 | (DE) | 10 2010 037 378 |
| Oct. 5, 2010 | (DE) | 10 2010 037 969 |
| Oct. 5, 2010 | (DE) | 20 2010 008 725 U |

(51) Int. Cl.
*F02B 33/44* (2006.01)

(52) U.S. Cl.
USPC ..... 60/605.3

(58) Field of Classification Search
USPC ..... 60/605.3, 599; 184/6.11; 123/196 R
See application file for complete search history.

(56) References Cited

U.S. PATENT DOCUMENTS

| | | | | |
|---|---|---|---|---|
| 4,285,200 | A * | 8/1981 | Byrne et al. | 60/599 |
| 4,813,408 | A * | 3/1989 | Katsumoto et al. | 184/6.11 |
| 4,958,600 | A * | 9/1990 | Janthur | 60/605.3 |
| 4,996,844 | A * | 3/1991 | Nancarrow | 60/608 |

(Continued)

FOREIGN PATENT DOCUMENTS

| | | |
|---|---|---|
| DE | 29723356 U1 | 8/1998 |
| DE | 102007017973 A1 | 1/2008 |

(Continued)

OTHER PUBLICATIONS

Machine translation of DE102007050259A1 filed Apr. 23, 2009 attached (obtained from espacenet.com on Sep. 18, 2013).*

*Primary Examiner* — Thomas Denion
*Assistant Examiner* — Ngoc T Nguyen
(74) *Attorney, Agent, or Firm* — Julia Voutyras; Alleman Hall McCoy Russell & Tuttle LLP

(57) ABSTRACT

Embodiments for cooling a turbine of an engine are provided. In one example embodiment, an internal combustion engine comprises a turbocharger including a turbine having a coolant jacket integrated in a housing of the turbine, and an oil circuit coupled to the coolant jacket of the turbine. By cooling the turbine with the oil circuit, the turbine may be constructed from less-heat resistant materials.

20 Claims, 5 Drawing Sheets

(56) References Cited

U.S. PATENT DOCUMENTS

| | | | | |
|---|---|---|---|---|
| 6,394,078 | B1 * | 5/2002 | Kling | 123/572 |
| 6,513,328 | B2 * | 2/2003 | Baeuerle et al. | 60/599 |
| 7,430,994 | B2 * | 10/2008 | Petutsching et al. | 123/41.82 R |
| 7,476,090 | B2 * | 1/2009 | Wood | 60/605.3 |
| 2008/0277201 | A1 * | 11/2008 | Taguchi et al. | 184/6.5 |
| 2010/0175374 | A1 * | 7/2010 | Steiner et al. | 123/41.72 |
| 2012/0055424 | A1 * | 3/2012 | Kuhlbach | 123/41.31 |
| 2012/0085299 | A1 * | 4/2012 | Kuhlbach et al. | 123/41.72 |
| 2012/0174580 | A1 * | 7/2012 | Kuhlbach et al. | 60/616 |
| 2013/0031901 | A1 * | 2/2013 | Kuhlbach et al. | 60/599 |

FOREIGN PATENT DOCUMENTS

| | | | | | |
|---|---|---|---|---|---|
| DE | 102007050259 | A1 | * | 4/2009 | F01P 3/22 |
| DE | 102008011257 | A1 | | 9/2009 | |
| EP | 1384857 | A2 | | 1/2004 | |
| EP | 1640596 | B1 | | 11/2008 | |
| GB | 2348670 | A | | 10/2000 | |
| JP | 57146025 | A | * | 9/1982 | |
| JP | 58135325 | A | * | 8/1983 | |
| JP | 59032621 | A | * | 2/1984 | |
| JP | 60040731 | A | * | 3/1985 | |
| JP | 61038126 | A | * | 2/1986 | |
| JP | 61123719 | A | * | 6/1986 | |
| JP | 61135933 | A | * | 6/1986 | |
| JP | 2533346 | B2 | | 9/1996 | |

* cited by examiner

500

INTERNAL COMBUSTION ENGINE WITH LIQUID-COOLED TURBINE

RELATED APPLICATIONS

The present application is a continuation-in-part of U.S. patent application Ser. No. 13/099,702, filed May 3, 2011 and entitled "INTERNAL COMBUSTION ENGINE WITH LIQUID COOLING," which claims priority to European Patent Application No. 10161879.01, filed May 4, 2010, the entire contents of each of which is hereby incorporated by reference.

The present application is also a continuation-in-part of U.S. patent application Ser. No. 13/226,267, filed on Sep. 6, 2011 and entitled "CYLINDER HEAD WITH TURBINE," which claims priority to German Patent Application No. 102010037378.8, filed on Sep. 7, 2010, the entire contents of each of which is hereby incorporated by reference.

The present application also claims priority to German Patent Application No. 102010037969.7, filed on Oct. 5, 2010, and German Patent Application No. 202010008725.2, filed Oct. 5, 2010, the entire contents of each of which are hereby incorporated by reference.

FIELD

The disclosure relates to an internal combustion engine having at least one liquid-cooled turbine.

BACKGROUND AND SUMMARY

Internal combustion engines have a cylinder block and a cylinder head, which are connected to one another at the assembly faces thereof to form the at least one cylinder, i.e. combustion chamber. The cylinder block includes cylinder bores to hold the pistons. The cylinder head generally serves to accommodate the valve gear. The valve gear includes the intake and exhaust valves as well as the valve actuating mechanism required to move the valves.

Typically, the inlet ducts, which lead to the inlet ports, and the outlet ducts, i.e. the exhaust lines, which are connected to the outlet ports, are at least partially integrated into the cylinder head. The exhaust lines of the outlet ports of each individual cylinder are generally brought together—within the cylinder head—to form a component exhaust line. The exhaust lines are combined into an overall exhaust line referred to generally and in the context of the present disclosure as an exhaust manifold. Downstream of the at least one manifold, the exhaust gases are then fed to a radial turbine, e.g. the turbine of an exhaust turbocharger and, if appropriate, are passed through one or more exhaust gas after treatment systems.

The production costs for the turbine are comparatively high since the material—which frequently contains nickel—used for the thermally highly stressed turbine casing is expensive, especially in comparison with the material that is preferably used for the cylinder head; e.g. aluminum.

It would be advantageous in terms of costs if it were possible to provide a turbine which could be manufactured from a less expensive material, e.g. aluminum. To enable less expensive materials to be used to produce the turbine, turbines may be provided with a cooling system, e.g. a liquid cooling system, which greatly reduces the thermal stress imposed by the hot exhaust gases on the turbine and on the turbine casing and hence allows the use of materials less capable of bearing thermal stresses.

In general, the turbine casing is provided with a coolant jacket in order to form the cooling system. This includes both concepts in which the casing is a casting and the coolant jacket is formed as an integral part of a monolithic casing as part of the casting process, and concepts in which the casing is of modular construction, where a cavity which serves as a coolant jacket is formed during assembly.

A turbine configured in accordance with the last-mentioned concept is described by German Laid-Open Application DE 10 2008 011 257 A1, for example. A liquid cooling system for the turbine is formed by providing the actual turbine casing with a shell, thus forming a cavity, into which coolant can be passed, between the casing and the at least one shell element arranged at a distance. The casing with the shell added then includes the coolant jacket. EP 1 384 857 A2 likewise discloses a turbine, the casing of which is provided with a coolant jacket. DE 10 2007 017 973 A1 describes a kit for the formation of a vapor-cooled turbine jacket.

In principle, there is the possibility of providing the liquid cooling system of the turbine with a separate heat exchanger or the heat exchanger of another liquid cooling system. However, one factor that has to be taken into account in this context is that the amount of heat to be absorbed by the coolant in the turbine can be 40 kW or more if materials with little resistance to thermal stress, such as aluminum, are used for the production of the casing. Removing such a large amount of heat from the coolant in the heat exchanger and dissipating it to the environment by means of an air flow proves to be problematic, as surface area available for heat transfer may be limited.

In addition to the heat exchanger of the engine cooling system, modern motor vehicles often have additional heat exchangers, in particular cooling devices. For example, charge air coolers, oil coolers, EGR coolers, transmission fluid coolers, air conditioning condenser, etc., may all be arranged in or near the front end zone. Thus, owing to the very restricted space conditions in the front end zone and the large number of heat exchangers, it may not be possible to dimension the individual heat exchangers as required. Also, there may be no possibility of arranging a sufficiently large heat exchanger for liquid cooling of the turbine in the front end zone to allow dissipation of the large amounts of heat. There has therefore to be a compromise between cooling capacity and material in the design configuration of a cooled turbine.

The inventors herein have recognized the above issues and have developed a system to at least partly address them. Accordingly, an internal combustion engine is provided. The engine comprises a turbocharger including a turbine having a coolant jacket integrated in a housing of the turbine, and an oil circuit, the oil circuit coupled to the coolant jacket of the turbine.

The present disclosure may provide several advantages. For example, it makes it possible to dispense with materials with the capacity to bear high thermal stresses, especially those containing nickel, for the production of the turbine casing, since the present description also makes provision for the turbine to be provided with a cooling system. The cooling system ensures a reduction in temperature and hence reduces the thermal stress on the material, rendering materials resistant to high temperatures unnecessary. On the other hand, utilizing oil as a coolant results in a cooling capacity that is not so large that materials with only little resistance to thermal stress, such as aluminum, can be employed. This approach makes the use of expensive materials unnecessary without dissipating excessively large amounts of heat in the context of turbine cooling.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
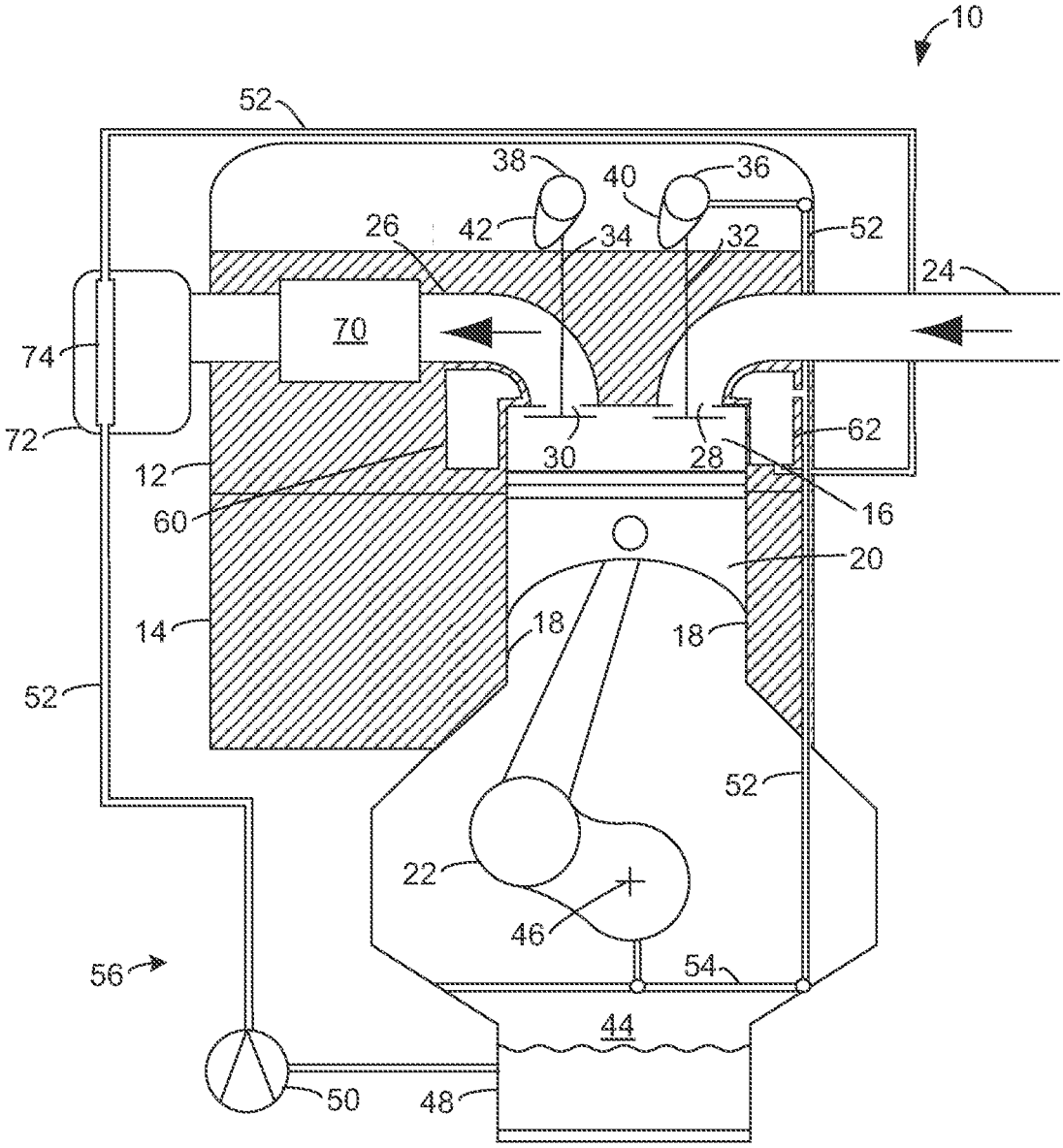
FIG. 1 schematically shows a cylinder of an internal combustion engine according to an embodiment of the present disclosure.
Figure 2:
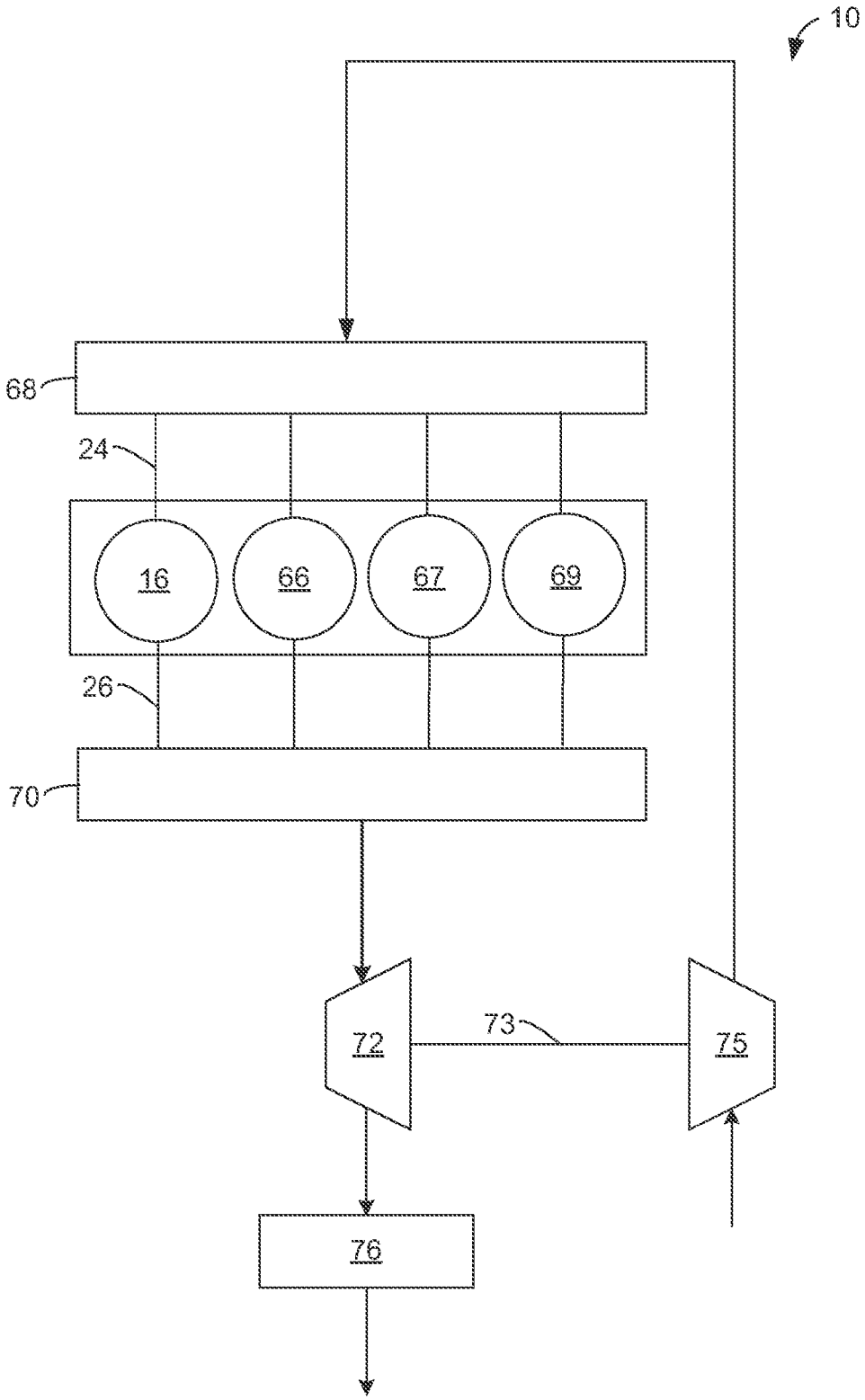
FIG. 2 schematically shows multiple cylinders of the internal combustion engine of FIG. 1.
Figure 3:
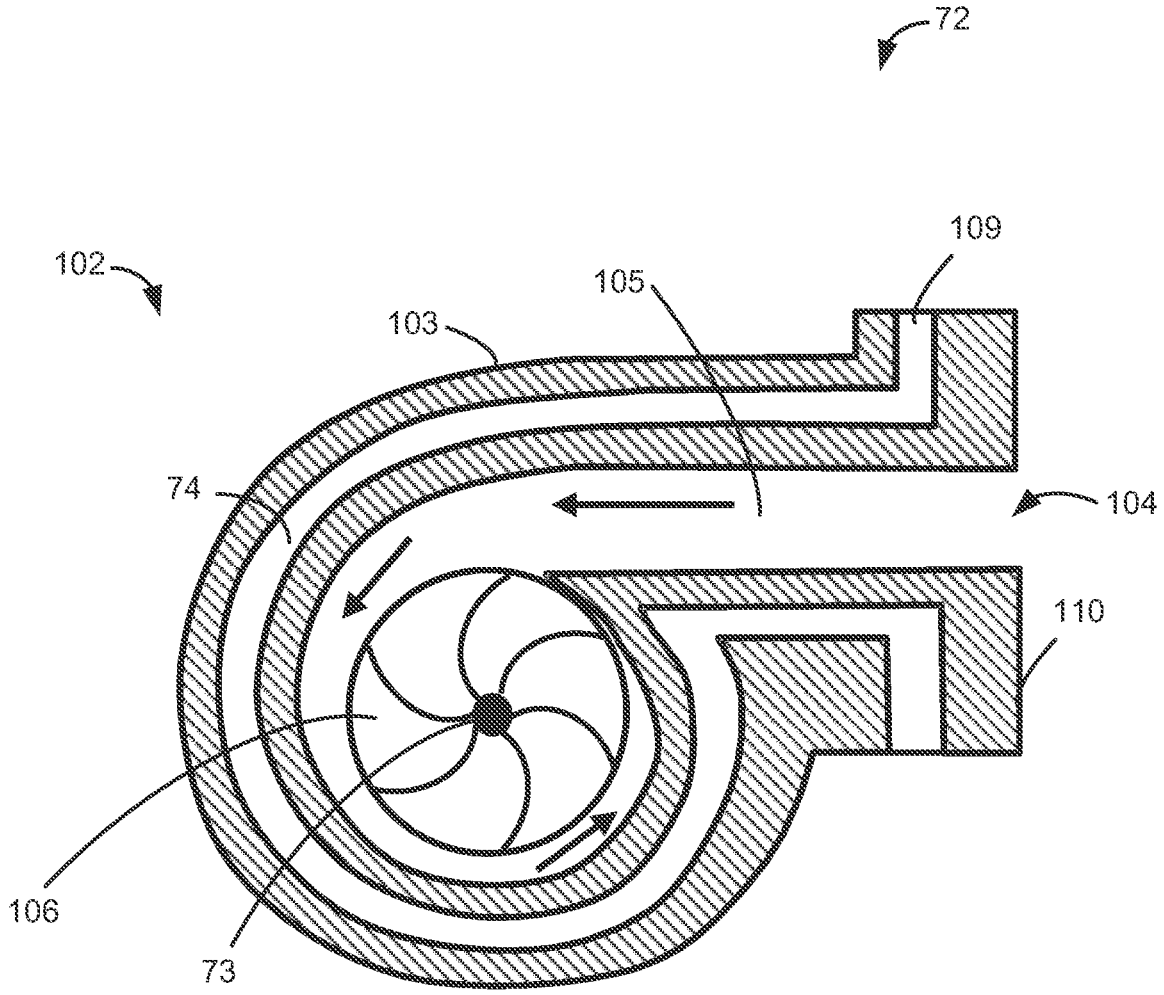
FIG. 3 shows an embodiment of a turbine in a section perpendicular to a shaft of the turbine rotor.
Figure 4:
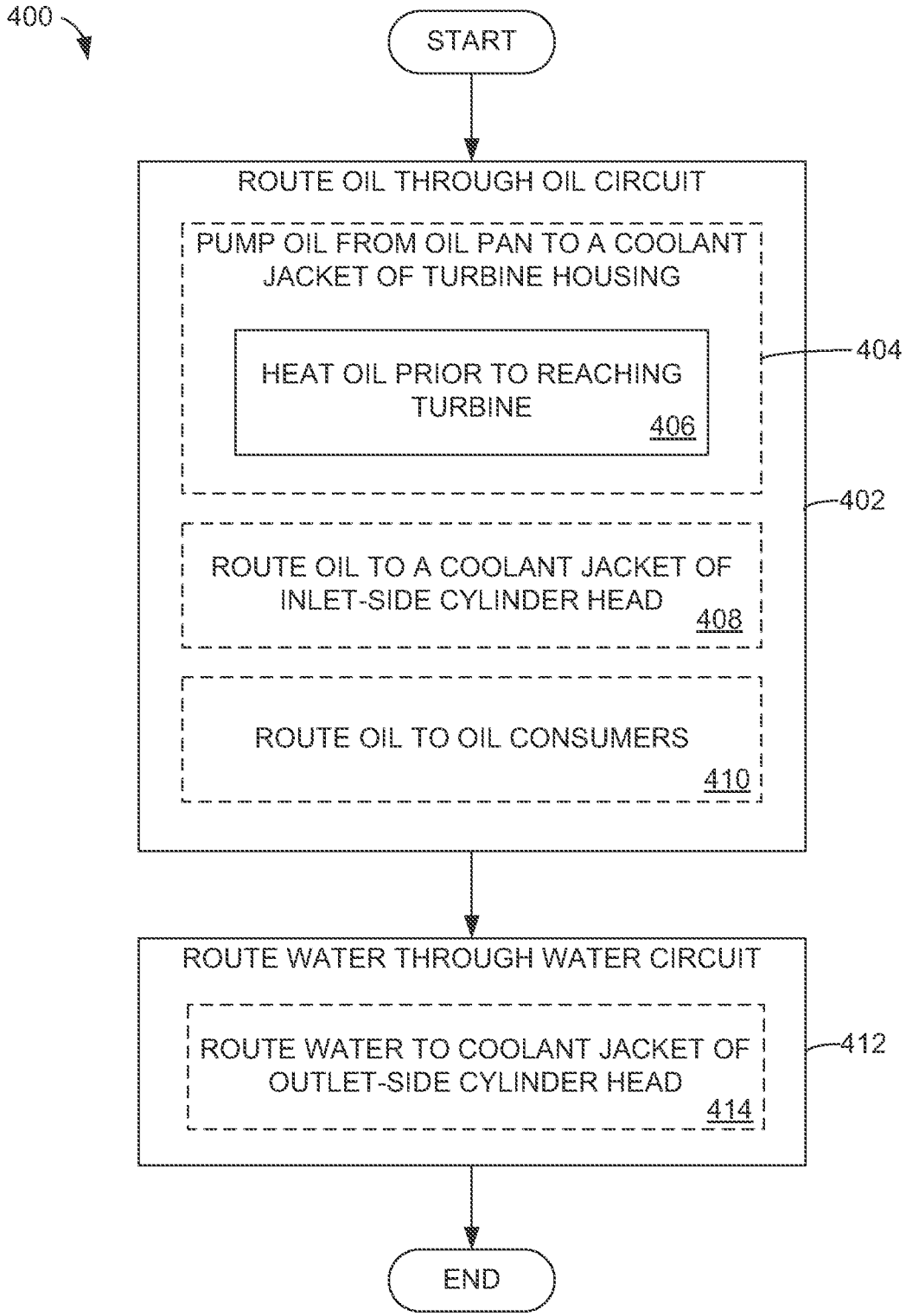
FIG. 4 shows flow chart illustrating an example method for an oil circuit according to an embodiment of the disclosure.
Figure 5:
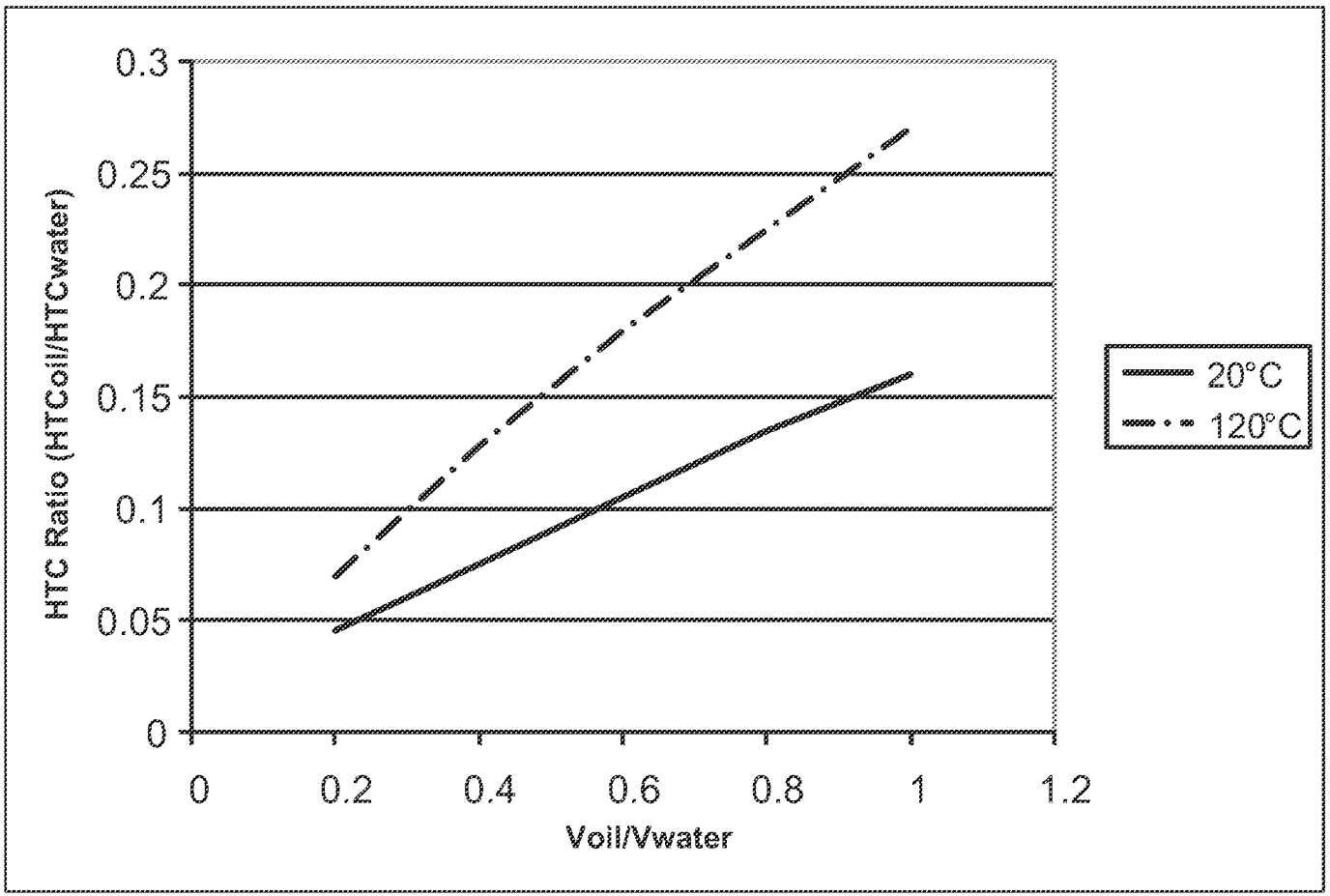
FIG. 5 shows a diagram illustrating the ratio of the heat transfer coefficients of two different coolants as a function of the coolant temperature and the through flow rate.

The use of a turbine constructed with material having high thermal stress capacity is often expensive and inefficient. To use material having a lower thermal stress capacity, the turbine may be cooled by an oil circuit of the engine. An example cylinder of an engine including an oil circuit and turbine is shown in FIG. 1. A multi-cylinder engine including the cylinder depicted in FIG. 1 is shown in FIG. 2, an example turbine is shown in FIG. 3, and a method for the oil circuit is shown in FIG. 4. FIG. 5 shows a diagram illustrating the heat transfer coefficients of two coolants that may be used in coolant circuits according to the disclosure.

FIG. 1 is a schematic diagram showing one cylinder 16 of a multi-cylinder engine 10, which may be included in a propulsion system of an automobile. The engine 10 includes a cylinder head 12 and a cylinder block 14 which are connected to one another at their assembly end sides so as to form a combustion chamber.

Combustion chamber (i.e. cylinder) 16 of engine 10 may include combustion chamber walls 18 with piston 20 positioned therein. Piston 20 may be coupled to crankshaft 22 so that reciprocating motion of the piston is translated into rotational motion of the crankshaft. Crankshaft 22 may be coupled to at least one drive wheel of a vehicle via an intermediate transmission system. Further, a starter motor may be coupled to crankshaft 22 via a flywheel to enable a starting operation of engine 10.

Combustion chamber 16 may receive intake air from an intake manifold (not shown) via intake line, or intake passage, 24 and may exhaust combustion gases via exhaust line, or exhaust passage, 26. Exhaust passage 26 may be coupled to an exhaust manifold 70, which in the depicted embodiment is integrated into cylinder head 12. Intake passage 24 and exhaust passage 26 can selectively communicate with combustion chamber 16 via inlet opening 28 and outlet opening 30 and respective intake valve 32 and exhaust valve 34. In some examples, combustion chamber 16 may include two or more intake valves and/or two or more exhaust valves.

During operation, each cylinder within engine 10 typically undergoes a four stroke cycle: the cycle includes the intake stroke, compression stroke, expansion stroke, and exhaust stroke. During the intake stroke, generally, the exhaust valve 34 closes and intake valve 32 opens. Air is introduced into combustion chamber 16 via intake passage 24, and piston 20 moves to the bottom of the cylinder so as to increase the volume within combustion chamber 16. The position at which piston 20 is near the bottom of the cylinder and at the end of its stroke (e.g. when combustion chamber 16 is at its largest volume) is typically referred to by those of skill in the art as bottom dead center (BDC). During the compression stroke, intake valve 32 and exhaust valve 34 are closed. Piston 20 moves toward the cylinder head so as to compress the air within combustion chamber 16. The point at which piston 20 is at the end of its stroke and closest to the cylinder head (e.g. when combustion chamber 16 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as a spark plug (not shown), resulting in combustion. During the expansion stroke, the expanding gases push piston 20 back to BDC. Crankshaft 22 converts piston movement into a rotational torque of the rotary shaft. Finally, during the exhaust stroke, the exhaust valve 34 opens to release the combusted air-fuel mixture to exhaust passage 26 and the piston returns to TDC. Note that the above is shown merely as an example, and that intake and exhaust valve opening and/or closing timings may vary, such as to provide positive or negative valve overlap, late intake valve closing, or various other examples.

A valve actuating device depicted in FIG. 1 comprises two camshafts 36 and 38, on which a multiplicity of cams 40, 42 are arranged. A basic distinction is made between an underlying camshaft and an overhead camshaft. This relates to the parting plane, that is to say assembly surface, between the cylinder head and cylinder block. If the camshaft is arranged above said assembly surface, it is an overhead camshaft, otherwise it is an underlying camshaft. Overhead camshafts are preferably mounted in the cylinder head, and are depicted in FIG. 1.

The cylinder head 12 is connected, at an assembly end side, to a cylinder block 14 which serves as an upper half of a crankcase 44 for holding the crankshaft 22 in at least two bearings, one of which is depicted as crankshaft bearing 46. At the side facing away from the cylinder head 12, the cylinder block 14 is connected to an oil pan 48 which serves as a lower crankcase half and which is provided for collecting and storing engine oil. The oil pan 48 serves as a heat exchanger for reducing the oil temperature when the internal combustion engine 10 has warmed up. Here, the oil situated in the oil pan 48 is cooled by means of heat conduction and convection by means of an air flow conducted past the outer side.

A pump 50 is provided for feeding the engine oil via a supply line 52 to a main engine oil gallery 54. The engine oil gallery 54 may be arranged above or below the crankshaft 22 in the crankcase 44 or else integrated into the crankshaft 22. Ducts lead from the main oil gallery to feed at least one consumer within an oil circuit 56. Example oil consumers include bearings of the camshaft and crankshaft, hydraulically actuable camshaft adjusters or other valve drive components, etc. In contrast, according to other systems, the supply line leads from the pump through the cylinder block to the camshaft receptacle, and in so doing, passes the so-called main oil gallery.

In previous systems, the pump which is provided is itself provided with engine oil originating from an oil pan via a suction line which leads from the oil pan to the pump, and said pump ensures an adequately high feed flow, that is to say an adequately high feed volume, and an adequately high oil pressure in the supply system, that is to say oil circuit, in particular in the main oil gallery.

The heat released during combustion by the exothermic chemical conversion of the fuel is dissipated in part to the cylinder head 12 and the cylinder block 14 via the walls bounding the combustion chamber 16 and in part to the adjoining components and the environment via the exhaust gas flow. To reduce the thermal stress on the cylinder head 12, some of the heat flow introduced into the cylinder head 12 may be removed from the cylinder head 12 again.

Owing to the significantly higher heat capacity of liquids relative to air, significantly larger amounts of heat can be dissipated by a liquid cooling system than with an air cooling system, for which reason cylinder heads of the type in question are advantageously provided with a liquid cooling system.

Liquid cooling requires that the cylinder head be provided with at least one coolant jacket, or the arrangement of coolant ducts which carry the coolant through the cylinder head, and this requires a cylinder head design with a complex structure. On the one hand, this means that the mechanically and thermally highly stressed cylinder head is weakened by the introduction of the coolant ducts. On the other hand, the heat does not first have to be conducted to the surface of the cylinder head in order to be dissipated, as with the liquid cooling system. The heat is released to the coolant, generally water containing additives, within the cylinder head itself. In this arrangement, the coolant is delivered by a pump arranged in the cooling circuit and thus circulates in the coolant jacket. In this way, the heat released to the coolant is dissipated from the interior of the cylinder head and removed from the coolant again in a heat exchanger.

The cooling capacity may be sufficiently high to eliminate or reduce enrichment ($\lambda<1$) in order to lower the temperature of the exhaust gas, as described in EP 1 722 090 A2, for example, which is regarded as disadvantageous from the point of view of energy considerations—especially as regards the fuel consumption of the internal combustion engine—and as regards pollutant emissions. This is because enrichment involves the injection of more fuel than can possibly be burnt with the quantity of air provided, with the additional fuel likewise being heated and vaporized, thus lowering the temperature of the combustion gases. In particular, the required enrichment does not typically allow the internal combustion engine to be operated in the manner that would, for example, be optimal for an exhaust gas aftertreatment system provided. That is to say this results in limitations in the operation of the internal combustion engine.

Thus, cylinder head 12 may include one or more coolant jackets 60, 62. As depicted in FIG. 1, coolant jacket 60 is located between exhaust passage 26 and the assembly end side of cylinder head 12, while coolant jacket 62 is located between intake passage 24 and the assembly end side of cylinder head 12. The cylinder head 12 of the internal combustion engine according to the disclosure has two coolant circuits which are independent of one another and which comprise in each case at least one coolant jacket, and which in particular can be and preferably are operated with different coolants. One coolant jacket 62 is located on an inlet side of the cylinder, that is, the coolant jacket is integrated into the cylinder head 12 at the side of the cylinder that is adjacent to and surrounding the intake passage 24. Another coolant jacket 60 is located on an outlet side of the cylinder, that is, the coolant jacket 60 is integrated into the cylinder head 12 at the side of the cylinder that is adjacent to and surrounding the exhaust passage 26.

This arrangement leaves free an adequate amount of installation space on that side of the cylinder head 12 which faces away from the block 14, for example for the arrangement of a camshaft receptacle, and leads to a compact design.

The cooling arrangement may reliably protect the internal combustion engine, in particular the cylinder head 12, against thermal overloading, and may preferably be efficient enough that an enrichment ($\lambda<1$) at high exhaust-gas temperatures can be dispensed with. This configuration or design of the liquid cooling arrangement makes it possible for the inlet side on the one hand and the outlet side on the other hand to be cooled as required, specifically independently of one another and according to the respective demand profile.

According to the present disclosure, the at least one coolant jacket 60 of one circuit is arranged at the outlet side and the at least one coolant jacket 62 of the other circuit is arranged at the inlet side, such that different cooling capacities can be realized for the inlet side and the outlet side, specifically not only through the use of different coolants. Moreover, the pump power of each circuit, and therefore also the coolant throughput, that is to say the feed volume, can be selected and set independently of one another. In this way, it is possible to influence the throughflow speed, which significantly co-determines the heat transfer by convection.

In this way, it is possible for less heat to be extracted from the cylinder head 12 at the inlet side and more heat to be extracted from the cylinder head 12 at the outlet side.

In particular, the internal combustion engine 10 according to the disclosure permits the use of oil as coolant for the inlet side in an oil circuit 56 and the use of water as coolant in a water circuit (not shown) for the thermally more highly or highly loaded outlet side of the cylinder head 12. In this embodiment, the cooling water circuit does not comprise an inlet-side coolant jacket. That is to say, the inlet side of the cylinder head 12 is exclusively oil cooled, for which reason the heat is not dissipated unused with the cooling water. Conversely, the oil circuit 56 may not comprise an outlet-side coolant jacket.

Oil has a lower heat capacity than water, as a result of which the cooling capacity at the inlet side can be reduced noticeably in relation to the use of water as coolant. This configuration of the liquid cooling arrangement makes it possible for heat to be extracted from the cylinder head 12 at the inlet side to the extent actually required to prevent overheating. In contrast, in previous systems, on account of the uniform use of water as coolant, the inlet side is cooled more intensely than is actually required, because the cooling arrangement is designed with regard to the thermally more highly loaded outlet side. The internal combustion engine 10 according to the disclosure is therefore optimized with regard to cooling. The efficiency of the internal combustion engine 10 is increased by the liquid cooling arrangement according to the disclosure.

Furthermore, the use of oil as coolant for the at least one inlet-side coolant jacket 62 has a further advantage. If the inlet-side coolant jacket 62 jointly forms the oil circuit 56 of the internal combustion engine, which oil circuit 56 supplies oil to consumers via a supply line 52, the engine oil is heated up more quickly after a cold start.

The oil specifically then flows, as it passes the cylinder head 12, through the inlet-side coolant jacket 62, the most innate function of which is the presently desired heat transfer. Here, the inlet-side coolant jacket 62 is utilized for heating the oil during the warm-up phase, and corresponding to its original function, for cooling the cylinder head 12 when the internal combustion engine 10 has warmed up. In both cases, the inlet-side coolant jacket 62 serves for introducing heat into the oil.

While the heat which is introduced into the coolant at the inlet side after a cold start advantageously ensures fast heating of the oil, and therefore increases the efficiency of the operation of the internal combustion engine 10. The heat which, in previous systems, is introduced into the cooling water serving as coolant is dissipated unused. The latter heat transfer even counteracts a fast heating of the oil. The heating of the oil during the warm-up phase is slowed here because a warm-up of the internal combustion engine, and therefore also heating of the oil as it passes the cylinder head or cylinder block, is counteracted.

With regard to the heating of the oil during the warm-up phase, the inlet-side coolant jacket 62 has out of principle proven to be extremely suitable. Firstly, the inlet-side coolant jacket 62 has an expanded volume region to provide a large surface area, in particular in comparison with an oil supply line, which has a relatively small surface area. The expanded volume region may extend from an area adjacent to the intake passage 24 down to the assembly end side of the cylinder head 12, and may substantially surround an area around an intake passage port. This increased surface area increases the heat transfer by convection. Secondly, the cylinder head 12 into which the coolant jacket 62 is integrated is thermally particularly highly loaded, which promotes the introduction of heat into the engine oil during the warm-up phase on account of the comparatively large temperature difference or temperature gradient.

Therefore, for the reasons stated above, embodiments of the internal combustion engine are particularly advantageous in which the at least one outlet-side coolant jacket 60 belongs to a cooling water circuit, whereas the at least one inlet-side coolant jacket 62 belongs to an oil circuit 56. The two coolant circuits, specifically the cooling water circuit on the one hand and the cooling oil circuit 56 on the other hand, are separate from one another.

Thus, the oil circuit 56 comprises the oil pan 48, which provides oil to the oil pump 50. The supply line 52, upstream of the main oil gallery 54, leads through the cylinder head 12, preferably through the inlet-side coolant jacket 62 of the cylinder head 12. The supply line 52 of the oil circuit 56 firstly leads through the cylinder head 12 before said supply line 52 enters into the cylinder block 14. The supply line 52 opens out, downstream, into the main oil gallery 54. While in the embodiment depicted in FIG. 1 the oil supply line 52 is shown both outside the cylinder head 12 as well as integrated in the cylinder head 12, it is to be understood that virtually any configuration of the supply line 52 is within the scope of this disclosure. For example, the supply line 52 may be fully integrated within the cylinder head and/or cylinder block.

In the oil circuit 56, the oil is heated in the cylinder head 12 and then is it used for lubricating engine components, such as the bearings 46 of the crankshaft 22. While it is the case in the systems described previously that the engine oil flows from the main oil gallery to the cylinder head, in the present case, said oil is conducted from the cylinder head 12 to the main oil gallery 54, which reduces the friction in the bearings and reduces fuel consumption.

To supply the camshafts 36, 38 with oil, the supply line 52 may further lead from the inlet-side coolant jacket 62 to the camshafts 36, 38.

This embodiment makes use of the fact that the cylinder head 12 is thermally highly loaded, in particular is thermally more highly loaded than the cylinder block 14, such that the heating of the oil, that is to say the rise in the oil temperature, as said oil flows through the cylinder head 12 is more pronounced than when said oil flows through the cylinder block 14.

After a cold start, the cylinder head 12 warms up more quickly, in particular in relation to the cylinder block 14, as a result of the combustion processes taking place. The embodiment in FIG. 1 ensures that the crankshaft bearings 46 are supplied with pre-heated oil more quickly, and in particular prevents a situation in which the oil entering into the cylinder head 12 has heat extracted from it upstream in the cylinder block 14.

As shown in FIG. 1, turbine 72 is coupled to cylinder head 12 on an outside of the cylinder head 12. However, in some embodiments, turbine 72 may be integrated in cylinder head 12. In order to provide a cooling mechanism to cool turbine 72, a coolant jacket 74 may be integrated in the housing of turbine 72. This turbine coolant jacket 74 may be part of oil circuit 56. Oil may be pumped from oil pan 48 via pump 50 in supply line 52 and fed through turbine coolant jacket 74 before entering the coolant jacket 62 on the inlet-side of cylinder head 12. In the embodiment depicted, the pump 50 and the coolant jacket 74 integrated in the housing are coupled to each other without an intervening consumer.

Providing the turbine 72 with a liquid cooling arrangement makes it possible to use thermally less highly loadable materials for producing the turbine housing, for example makes it possible to use low-alloy steels, cast iron or aluminum.

In particular, however, by using oil as coolant, the introduction of heat into the coolant can be limited and considerably reduced in relation to water coolant, since having to extract said very large amount of heat again from the water which serves as coolant, is eliminated. The fact that the amount of heat introduced into the coolant can be reduced by the use of oil as coolant can be attributed inter alia to the material properties of oil.

By use of the Nusselt number, a dimensionless characteristic value from similitude theory, it is possible to describe the heat transfer to a flowing fluid, for example also the introduction of heat into the coolant as it flows through the turbine housing. The Nusselt number is a material-dependent and therefore fluid-specific characteristic value. It is proportional to the heat transfer coefficient a during heat transfer as a result of convection, and is therefore a measure for the quality, that is to say the magnitude of the introduction of heat.

The Nusselt number of water is a multiple of the Nusselt number of oil, as a result of which the introduction of heat as a result of convection is considerably higher when using water as coolant, under otherwise identical boundary conditions, than when oil is used for cooling.

The housing of the turbine 72 may be produced from inexpensive materials on account of the liquid cooling arrangement provided, without having to dissipate excessively large amounts of heat, since the heat transfer in the housing is reduced in a targeted manner by the use, according to the embodiment, of oil.

Firstly, the internal combustion engine according to the disclosure makes it possible to dispense with thermally highly loadable, in particular nickel-containing materials for producing the turbine housing, since the turbine 72 is also provided, according to the disclosure, with a liquid cooling arrangement. Secondly, the cooling capacity, that is to say the introduction of heat into the coolant, is reduced by the use of oil, such that the amounts of heat to be dissipated do not constitute a problem in process terms.

A distinction is to be made between the oil cooling arrangement according to the disclosure and the oil supply which serves for lubricating the turbine shaft or the shaft bearings with oil. In principle, said oil supply also cools parts of the turbine or of the turbine housing. However, the turbine shaft oil supply itself has no coolant jacket, which clearly distinguishes the oil cooling arrangement according to the disclosure from the oil supply.

The amount of heat introduced into the coolant can be considerably reduced by the use of oil, and not only on account of the effects described in conjunction with the Nusselt number. Furthermore, it may be taken into consideration that oil can be heated to a considerably greater degree than water, which—assuming atmospheric pressure—evaporates at 100° C. The heat transfer in the housing can consequently also be further reduced by reducing the temperature difference between the housing and coolant, that is to say oil, by heating the oil. Oil can, in some cases, be heated to 200° C. or higher. An example diagram illustrating the relationship between the heat transfer coefficients of water and oil as a function of coolant temperature and coolant flow through is shown in FIG. 5.

Since the oil supply system of the internal combustion engine is connected to the coolant jacket 74 integrated in the turbine housing, the oil supply jointly forms the oil circuit 56 provided for the cooling of the housing, such that the other components and assemblies required to form a cooling circuit may basically be provided only singly and may be used both for the cooling circuit of the turbine and also for the oil supply, which leads to synergies and considerable cost savings, but also results in a weight saving. For example, only one pump for conveying the oil which serves as coolant, and one container for storing the oil, may be provided. The heat transferred to the oil in the housing and in the internal combustion engine can be dissipated in a common heat exchanger, such as the oil pan or another heat exchanger not depicted in FIG. 1.

Turning to FIG. 2, the engine 10 described with reference to FIG. 1 is depicted. Here, multiple cylinders of engine 10 are shown. In addition to cylinder 16, cylinders 66, 67, and 69 are depicted. While engine 10 is here depicted as a four-cylinder engine, it is to be understood that any number of cylinders in any arrangement is within the scope of this disclosure.

An intake manifold 68 provides intake air to the cylinders via intake passages, such as intake passage 24. After combustion, exhaust gasses exit the cylinders via exhaust passages, such as exhaust passage 26, to the exhaust manifold 70. The exhaust lines of at least two cylinders may be merged to form an overall exhaust line within the cylinder head, so as to form an integrated exhaust manifold that permits the densest possible packaging of the drive unit. The exhaust gasses may pass through one or more aftertreatment devices 76 before exiting to the atmosphere.

The engine 10 may be supercharged by means of an exhaust-gas turbocharger. The exhaust gas may pass through a turbine 72 to drive a compressor 75 to provide boosted intake air to engine 10. The turbine 72 may be coupled to the compressor by a shaft 73.

FIG. 3 shows an embodiment of the turbine 72 in a section perpendicular to the shaft 73 of the turbine rotor 106. In the depicted embodiment, the turbine 72 is a radial turbine 102, which comprises a rotor 106 arranged in a turbine casing 103 and rotatably supported on a shaft 107. To allow radial inflow to the rotor blades, the inlet zone 104, which merges downstream into a flow duct 105, is of spiral design and the casing 103 for supplying the exhaust gas is designed as a spiral casing which extends all the way round the rotor 106.

To form a cooling system, the casing 103 has an integrated coolant jacket 74, which extends in a spiral around the shaft 107 in the casing 103 and hence follows the flow duct 105 as far as the entry of the exhaust gas into the rotor 106. Provided adjacent to the inlet zone 104 of the turbine casing 103 are duct openings 109 to enable coolant to be introduced into and discharged again from the coolant jacket 74. To enable the turbine 101 to be attached to the cylinder head (not shown in FIG. 3), the casing 103 is provided with a flange 110.

According to an embodiment of the present disclosure, the turbine 72 is embodied as a radial turbine 102, and thus the flow entering the rotor blades is substantially radial. In this context, substantially radial means that the velocity component in the radial direction is larger than the axial velocity component. The velocity vector of the flow intersects the shaft 73 or axis of the turbine 102, more particularly at a right angle, if the flow entering is exactly radial. To this extent, the radial turbine 102 can also be of mixed-flow construction as long as the velocity component in the radial direction is larger than the velocity component in the axial direction.

To enable the flow to enter the rotor blades radially, the inlet zone 104 for feeding in the exhaust gas is often designed as a spiral or volute casing that extends all the way round, ensuring that the inflow of exhaust gas to the turbine 102 is substantially radial.

The cylinder head according to the present disclosure with a radial turbine 102 is suitable especially for pressure-charged internal combustion engines, which are subject to particularly high thermal stresses owing to the relatively high exhaust gas temperatures. Consequently, cooling of the turbine of the exhaust gas turbocharger is advantageous. Thus, in the embodiment depicted, the radial turbine 102 is included in a turbocharger.

Pressure charging is used primarily to boost the power of the internal combustion engine. The air required for the combustion process is compressed, enabling a larger air mass to be fed to each cylinder per working cycle. As a result, it is possible to increase the fuel mass and hence the mean pressure.

Pressure charging is a suitable way of boosting the power of an internal combustion engine while keeping the displacement unchanged or of reducing the displacement for the same power. In each case, pressure charging leads to an increase in power per unit installation volume and a more favorable power-to-mass ratio. Given identical vehicle boundary conditions, it is thus possible to shift the load population toward higher loads, where specific fuel consumption is lower. Consequently, pressure charging assists the constant effort in the development of combustion engines to minimize fuel consumption, that is to say, to improve the efficiency of internal combustion engines.

Compared with a mechanical charger, the advantage of an exhaust gas turbocharger is that there is no mechanical connection or no need for a mechanical connection to transmit power between the charger and the internal combustion engine. While a mechanical charger draws the energy required to drive it directly from the internal combustion engine, the exhaust gas turbocharger uses the energy of the hot exhaust gases.

As described above with respect to FIG. 2, the engine 10 including the turbocharger with the turbine according to the disclosure may include more than one cylinder. If the cylinder head has two cylinders and only the exhaust lines of one cylinder form an overall exhaust line which opens into the radial turbine, this is likewise a cylinder head according to the present disclosure.

If the cylinder head has three or more cylinders and only the exhaust lines of two cylinders combine to form an overall exhaust line, this is likewise a cylinder head according to the present disclosure.

Embodiments of the cylinder head in which, for example, the cylinder head has four cylinders arranged in series and the exhaust lines of the outer cylinders and the exhaust lines of the inner cylinders each combine to form an overall exhaust line are likewise cylinder heads according to the disclosure.

In the case of three and more cylinders, there is therefore also an advantage with embodiments in which at least three cylinders are configured in such a way that they form two groups, each comprising at least one cylinder, and the exhaust lines of the cylinders in each cylinder group in each case combine to form an overall exhaust line, thereby forming an exhaust manifold.

This embodiment is suitable especially for the use of a double-flow turbine. A double-flow turbine has an inlet zone with two inlet ducts, that is to say as it were two inlet zones, the two overall exhaust lines being connected to the double-flow turbine in such a way that one overall exhaust line opens into each inlet duct. Combination of the two exhaust flows carried in the overall exhaust lines may take place downstream of the turbine. If the exhaust lines are grouped in such a way that the high pressures, especially the exhaust lead pulses, can be preserved, a double-flow turbine is suitable especially for pulse charging, whereby it is possible to achieve high turbine pressure ratios at low rotational speeds.

However, grouping the cylinders and exhaust lines also offers advantages when using several turbines or exhaust gas turbochargers, with one overall exhaust line being connected to each turbine.

However, embodiments in which the exhaust lines of all the cylinders of the cylinder head are combined to form a single, or common, overall exhaust line are also advantageous, as depicted in FIG. 2.

While shown as a turbine 72 of radial type of construction, the turbine 72 may be of axial type of construction in other embodiments, that is to say the flow approaching the rotor blades runs substantially axially. Here, "substantially axially" means that the speed component in the axial direction is greater than the radial speed component.

The turbine 72 may be equipped with a variable turbine geometry, which enables a more precise adaptation to the respective operating point of the internal combustion engine an adjustment of the turbine geometry or of the effective turbine cross section. Here, guide blades for influencing the flow direction are arranged in the inlet region of the turbine 72. In contrast to the rotor blades of the rotating rotor, the guide blades do not rotate with the shaft of the turbine 72.

If the turbine 72 has a fixed, invariable geometry, the guide blades are arranged in the inlet region so as to be not only stationary but rather also completely immovable, that is to say rigidly fixed. In contrast, if use is made of a turbine 72 with variable turbine geometry, the guide blades are duly also arranged so as to be stationary but not so as to be completely immovable, rather so as to be rotatable about their axes, such that the flow approaching the rotor blades can be influenced.

FIG. 4 illustrates a method 400 for operating an oil circuit according to an embodiment of the disclosure. Method 400 may be configured in some conditions to rapidly heat an engine and engine oil circuit utilizing exhaust heat. In other conditions, method 400 may cool a turbine and engine and enable utilization of a turbine constructed from inexpensive materials.

Method 400 comprises, at 402, routing oil through an oil circuit. The oil circuit may comprise an oil pan located in the crankcase, an oil pump, and an oil supply line that leads to one or more components of the engine. For example, the oil may be pumped from the oil pan to the housing of a turbine coupled to the exhaust passage of the engine at 404. In doing so, the oil may be heated from the exhaust heat while simultaneously cooling the turbine. In some embodiments, in order to reduce the amount of heat the oil is able to extract from the turbine, the oil may be heated by a heater prior to reaching the turbine at 406.

After the oil is routed through the turbine, it may be routed to a coolant jacket located in an inlet side of the cylinder head at 408. Here, the oil may act to heat the engine under conditions of cold engine start. However, when the engine reaches standard operating temperature and no longer requires heating, the oil may act to cool the engine. To do so, the oil may be routed through a heat exchanger positioned between the turbine and the coolant jacket.

The oil may then be routed to one or more oil consumers of the engine at 410. Example oil consumers include crankshaft and camshaft bearings, valve drive components, etc. The oil delivered to the oil consumers may be used to lubricate various engine parts. As the oil lubricates the engine components, some may return to the oil pan via gravity in order to complete the oil circuit.

When method 400 acts in an engine cooling capacity, it may also include cooling an outlet side of the cylinder head. In this embodiment, the outlet side may be cooled by a separate water cooling circuit. Thus, method 400 also comprises, at 412, routing water through a water circuit. The water circuit may comprise a standard engine coolant circuit including a coolant pump, radiator or other heat exchanger, etc. Routing water through the water circuit may include routing water through a coolant jacket located at the outlet side of the cylinder head at 414.

Thus, method 400 provides for cooling an engine with two separate cooling circuits, an oil circuit and a water circuit. By providing two separate circuits, method 400 may provide different levels of cooling to the inlet and outlet sides of the cylinder head, which have different levels of cooling requirements. Additionally, method 400 includes utilizing the oil circuit to cool a turbine. By doing so, less expensive and more lightweight materials may be used to construct the turbine. Further, when the oil passes through the turbine, it may be rapidly heated, and this heat may be transferred to heat the engine. Thus, the oil circuit may increase engine efficiency by allowing for a more lightweight turbine and more rapid engine heating.

FIG. 5 shows, in a diagram 500, the ratio (HTC Ratio) of the heat transfer coefficients $HTC_{oil}$ and $HTC_{water}$ of two different coolants as a function of the coolant temperature $T_{coolant}$ and the throughflow rate V.

As coolant, use is made on the one hand of oil ($HTC_{oil}$ and $V_{oil}$) and on the other hand of water ($HTC_{water}$ and $V_{water}$). The cooling water which is used may be a mixture of water and glycol.

The dimensionless ratio HTC Ratio of the heat transfer coefficients $HTC_{oil}$ and $HTC_{water}$ is plotted on the y-axis, and the through flow rate is plotted, likewise as a dimensionless ratio $V_{oil}/V_{water}$, on the x-axis.

If the coolant temperature rises, for example from $T_{coolant}$=20° C. to $T_{coolant}$=120° C., the heat transfer coefficient of the oil increases noticeably in relation to the coefficient of cooling water. This clearly shows that, at relatively high coolant temperatures, cooling by oil has advantages with regard to heat dissipation, that is to say oil provides a more intense cooling action.

It also emerges from the diagram that—even when using oil as coolant—the heat transfer coefficient increases with the through flow rate, since the flow speed rises with the through flow rate. In particular, however, it also emerges from the diagram that, as a result of the use of oil as coolant, the introduction of heat into the coolant is considerably reduced in relation to cooling by water. The basis for this is that the heat transfer coefficient $HTC_{water}$ of water is a multiple greater than the coefficient $HTC_{oil}$ of oil.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for cooling a turbine of an internal combustion engine, comprising:

routing engine oil via an oil circuit to the turbine;

increasing a temperature of the engine oil prior to reaching the turbine; and routine engine oil from the turbine to a coolant jacket on an inlet side of a cylinder head, the inlet side of the cylinder head being exclusively oil-cooled.

2. The method of claim 1, wherein the turbine is integrated in the cylinder head of the engine.

3. The method of claim 2, further comprising routing the engine oil from the inlet-side coolant jacket to an oil pan, the oil pan configured to provide the engine oil to the oil circuit.

4. The method of claim 2, further comprising routing water to a coolant jacket on an outlet side of the cylinder head, and wherein the oil circuit does not comprise a coolant jacket on the outlet side of the cylinder head.

5. The method of claim 1, further comprising routing the engine oil through a heater in order to increase the temperature of the engine oil prior to reaching the turbine.

6. A method for an oil circuit of an engine, comprising:

operating an oil pump to route oil from an oil pan through a first coolant jacket of a turbine coupled to an exhaust passage of the engine, the oil from the first coolant jacket then routed through a second coolant jacket on an inlet side of a cylinder head to one or more oil consumers of the engine before passing to the oil pan, the oil heated by the first coolant jacket prior to reaching the second coolant jacket.

7. The method of claim 6, wherein the one or more oil consumers of the engine include crankshaft and/or camshaft bearings.

8. The method of claim 6, further comprising operating a coolant pump to route water through a third coolant jacket of an outlet side of the cylinder head.

9. An internal combustion engine, comprising:

an engine including a cylinder head having an inlet-side coolant jacket;

a turbocharger including a turbine having a second coolant jacket integrated in a housing of the turbine; and an oil circuit coupled to the inlet-side coolant jacket and the second coolant jacket of the turbine, oil in the oil circuit routed from the second coolant jacket to the inlet-side coolant jacket before returning to an oil pan.

10. The internal combustion engine as claimed in claim 9, further comprising a pump for delivering oil in the oil circuit.

11. The internal combustion engine as claimed in claim 9, further comprising a heat exchanger in the oil circuit.

12. The internal combustion engine as claimed in claim 9, wherein the oil circuit supplies oil to at least one consumer to lubricate moving parts of the internal combustion engine.

13. The internal combustion engine as claimed in claim 9, further comprising:

a cylinder block which is connected to the cylinder head and which serves as an upper crankcase half and which is connected, on a side facing away from the cylinder head, to the oil pan which serves as a lower crankcase half and which serves for collecting and storing engine oil; and a pump for delivering the engine oil via a supply line to at least one consumer within the oil circuit.

14. The internal combustion engine as claimed in claim 13, wherein the supply line leads, downstream of the pump, to the second coolant jacket integrated in the housing.

15. The internal combustion engine as claimed in claim 13, wherein the pump and the second coolant jacket integrated in the housing are coupled to each other without an intervening consumer.

16. The internal combustion engine as claimed in claim 13, further comprising:

at least one cylinder;

at an outlet side of the cylinder head, at least one outlet opening for each cylinder for discharging exhaust gases; and at the inlet side of the cylinder head, at least one inlet opening for each cylinder for supplying fresh air, wherein in the cylinder head, a third coolant jacket is arranged at the outlet side, with said inlet-side and third coolant jackets being separate from one another and belonging to different, separate coolant circuits.

17. The internal combustion engine as claimed in claim 16, wherein the third coolant jacket belongs to a cooling water circuit.

18. The internal combustion engine as claimed in claim 17, further comprising one overall exhaust line within the cylinder head forming one integrated exhaust manifold, the one overall exhaust line coupled to an exhaust line of each cylinder.

19. The internal combustion engine as claimed in claim 9, wherein the inlet-side coolant jacket includes an inlet to receive oil from the second coolant jacket and an outlet to provide oil to an oil supply line leading a main engine oil gallery.

20. The internal combustion engine as claimed in claim 19, wherein the inlet-side coolant jacket and the inlet and the outlet of the inlet-side coolant jacket are all arranged between an intake passage of the engine and an assembly end side of the cylinder head, the assembly end side of the cylinder head connected to a cylinder block.

* * * * *